US009777982B2

(12) United States Patent
Curry

(10) Patent No.: US 9,777,982 B2
(45) Date of Patent: Oct. 3, 2017

(54) SHROUDED BARREL AND SIGHT FOR REVOLVER

(71) Applicant: Smith & Wesson Corp., Springfield, MA (US)

(72) Inventor: Brett Curry, Munson, MA (US)

(73) Assignee: Smith & Wesson Corp., Springfield, MA (US)

( * ) Notice: Subject to any disclaimer, the term of this patent is extended or adjusted under 35 U.S.C. 154(b) by 15 days.

(21) Appl. No.: 15/345,679

(22) Filed: Nov. 8, 2016

(65) Prior Publication Data

US 2017/0067714 A1 Mar. 9, 2017

Related U.S. Application Data

(60) Division of application No. 14/339,922, filed on Jul. 24, 2014, now Pat. No. 9,488,432, which is a continuation of application No. 14/044,079, filed on Oct. 2, 2013, now Pat. No. 8,789,303, which is a division of application No. 12/648,902, filed on Dec. 29, 2009, now Pat. No. 8,549,782.

(60) Provisional application No. 61/141,715, filed on Dec. 31, 2008.

(51) Int. Cl.

| | |
|---|---|
| ***F41C 3/14*** | (2006.01) |
| ***F41A 17/74*** | (2006.01) |
| ***F41A 17/00*** | (2006.01) |
| ***F41C 3/16*** | (2006.01) |
| ***F41A 17/72*** | (2006.01) |
| ***F41A 21/44*** | (2006.01) |
| ***F41G 1/02*** | (2006.01) |

(52) U.S. Cl.

CPC ..... *F41C 3/14* (2013.01); *F41A 17/00* (2013.01); *F41A 17/72* (2013.01); *F41A 17/74* (2013.01); *F41A 21/44* (2013.01); *F41C 3/16* (2013.01); *F41G 1/02* (2013.01)

(58) Field of Classification Search

CPC .... F41C 3/14; F41C 3/16; F41A 17/74; F41A 17/00; F41A 17/72; F41A 21/44; F41G 1/02

USPC ..... 42/71.01

See application file for complete search history.

(56) References Cited

U.S. PATENT DOCUMENTS

| | | | | |
|---|---|---|---|---|
| 624,620 | A | 5/1899 | Brown | |
| 678,274 | A | 7/1901 | Owen | |
| 688,141 | A | 12/1901 | Wesson | |
| 743,784 | A | 11/1903 | Wesson | |
| 847,011 | A | 3/1907 | Kolb et al. | |
| 917,723 | A | 9/1909 | Ehbets | |
| 1,181,417 | A | 5/1916 | Wesson | |
| 1,518,027 | A | 12/1924 | Vosmek | |
| 1,630,404 | A | 5/1927 | Nicholson | |
| 1,759,772 | A * | 5/1930 | Williams | F41A 21/10 42/77 |
| 2,382,676 | A | 8/1945 | Swartz | |
| 2,958,151 | A | 11/1960 | Sefried | |
| 3,030,723 | A | 4/1962 | Ivy | |

(Continued)

*Primary Examiner* — Michelle R Clement
(74) *Attorney, Agent, or Firm* — Ballard Spahr LLP

(57) ABSTRACT

A revolver has a shroud for housing a barrel. The shroud has a receptacle formed on an upper surface. The receptacle is aligned with one sight receiving flat on an exterior periphery of the barrel. The flat is located adjacent to the muzzle end of the barrel. A front sight is disposed within the receptacle. A bottom portion of the sight is in registration with the flat so as to prevent rotation of the barrel.

2 Claims, 6 Drawing Sheets

(56) References Cited

U.S. PATENT DOCUMENTS 3,086,310 A 4/1963 Katz
3,157,958 A 11/1964 Lewis
3,173,221 A 3/1965 Ivy
3,177,602 A 4/1965 Geber
3,221,433 A 12/1965 Lewis
3,237,336 A 3/1966 Lewis
3,387,399 A 6/1968 McLenahan
RE26,534 E 3/1969 Lewis
3,624,947 A 12/1971 Worrall, Sr.
3,685,193 A 8/1972 Sefried, II
3,696,543 A 10/1972 Kennedy et al.
3,724,113 A 4/1973 Ludwig
3,748,771 A 7/1973 Piscetta
3,750,319 A 8/1973 Roy
3,755,950 A 9/1973 Gunn
3,803,741 A 4/1974 Ducommun
3,813,804 A 6/1974 Ruger
3,838,533 A 10/1974 Ruger
3,874,104 A 4/1975 Sibley
3,988,848 A 11/1976 Chatigny
3,996,687 A 12/1976 Helbling
4,015,354 A * 4/1977 Brouthers ..... F41G 1/02 42/144
4,091,557 A 5/1978 Murabito
4,127,955 A 12/1978 Curran
4,133,127 A 1/1979 Piscetta
4,282,795 A 8/1981 Beretta
4,285,152 A 8/1981 Dean
4,304,061 A * 12/1981 Brouthers ..... F41A 21/488 42/59
4,437,250 A 3/1984 Beretta
4,449,312 A 5/1984 Ruger et al.
4,541,193 A 9/1985 Flippin
4,555,861 A 12/1985 Khoury
4,577,429 A 3/1986 Waiser
4,581,835 A 4/1986 Brouthers et al.
4,619,064 A 10/1986 Stolz
4,621,445 A 11/1986 Rohm
4,627,185 A 12/1986 Rohm
4,658,529 A 4/1987 Bertolini
4,694,602 A 9/1987 Pust
4,694,604 A 9/1987 Mitchell
4,720,930 A 1/1988 Schreiber
4,726,136 A 2/1988 Dornaus et al.
4,771,561 A 9/1988 Waiser
4,833,810 A * 5/1989 Domian ..... F41A 11/02 42/137
4,897,950 A 2/1990 Lechelle et al.
4,899,478 A 2/1990 Ghisoni
4,908,969 A 3/1990 Lechelle et al.
4,918,850 A 4/1990 Rick
4,934,081 A 6/1990 Mooney
4,964,602 A 10/1990 Reinhard
4,987,693 A 1/1991 Brooks
5,092,068 A 3/1992 Rick
5,157,209 A 10/1992 Dunn
D335,911 S 5/1993 Militello
5,259,138 A 11/1993 Scirica
5,341,587 A 8/1994 Phillips, Jr.
5,437,120 A 8/1995 Dornaus
5,438,784 A 8/1995 Lenkarski et al.
5,493,806 A 2/1996 Langevin et al.
5,622,160 A 4/1997 Casas Salva
5,928,763 A 7/1999 Howie, Jr.
6,266,908 B1 * 7/2001 Spencer ..... F41A 21/485 42/71.02
6,330,761 B1 12/2001 Duval et al.
6,397,506 B1 6/2002 Oglesby, Jr.
6,405,470 B1 6/2002 Strahan
6,415,702 B1 7/2002 Szabo et al.
6,513,273 B2 2/2003 da Silveira
6,523,294 B2 2/2003 Curry et al.
6,574,898 B2 6/2003 Spencer et al.
6,619,179 B2 * 9/2003 Mika ..... F41A 21/36 42/77
6,634,128 B1 10/2003 Vastag
6,647,654 B2 11/2003 Iten et al.
6,711,819 B2 3/2004 Stall et al.
6,928,763 B2 8/2005 Zajk et al.
6,941,692 B1 9/2005 Krinke et al.
6,948,273 B2 9/2005 Baker
7,059,075 B1 6/2006 Curry et al.
7,204,051 B2 4/2007 Thomele et al.
7,213,359 B2 5/2007 Beretta
7,243,453 B2 7/2007 McGarry
7,254,913 B2 * 8/2007 Dubois ..... F41A 3/74 42/1.07
7,263,795 B1 9/2007 Curry
7,406,793 B2 8/2008 McClellan
7,523,578 B2 4/2009 Ghisoni
7,562,478 B1 7/2009 Vastag
7,568,303 B2 8/2009 McClellan
7,703,230 B2 4/2010 Curry et al.
7,861,449 B1 1/2011 Zajk
7,861,450 B2 1/2011 Curry
7,886,469 B2 2/2011 Curry
7,900,389 B2 3/2011 Curry
7,975,418 B2 7/2011 Curry
8,549,782 B2 10/2013 Curry
8,572,878 B2 11/2013 Gentilini et al.
8,789,303 B2 7/2014 Curry
8,887,429 B2 * 11/2014 Zajk ..... F41C 3/14 42/65
9,488,432 B2 11/2016 Curry
2001/0042333 A1 * 11/2001 Spencer ..... F41A 21/485 42/75.02
2001/0054247 A1 12/2001 Stall et al.
2002/0020099 A1 2/2002 Silveira
2005/0055863 A1 3/2005 Zajk et al.
2005/0229462 A1 10/2005 McGarry
2006/0048428 A1 3/2006 Thomele et al.
2006/0123684 A1 6/2006 Bunney
2006/0162220 A1 7/2006 Curry et al.
2006/0242878 A1 11/2006 Dubois et al.
2007/0234622 A1 10/2007 McClellan
2009/0044436 A1 2/2009 Zajk
2010/0170129 A1 7/2010 Curry
2010/0170131 A1 7/2010 Zukowski
2011/0016761 A1 1/2011 Zajk
2011/0035982 A1 * 2/2011 Dubois ..... F41A 3/74 42/65
2011/0083351 A1 4/2011 Donnelly
2011/0094138 A1 * 4/2011 Dubois ..... F41A 3/74 42/59

* cited by examiner

SHROUDED BARREL AND SIGHT FOR REVOLVER

CROSS REFERENCE TO RELATED APPLICATIONS

This application is a division of U.S. patent application Ser. No. 14/339,922 filed Jul. 24, 2014, now U.S. Pat. No. 9,488,432 issued Nov. 8, 2016, which application is a continuation of U.S. patent application Ser. No. 14/044,079 filed Oct. 2, 2013, now U.S. Pat. No. 8,789,303, issued Jul. 29, 2014, which is a division of U.S. patent application Ser. No. 12/648,902 filed Dec. 29, 2009, now U.S. Pat. No. 8,549,782, issued Oct. 8, 2013, that patent claiming the benefit of U.S. Provisional Application No. 61/141,715, filed on Dec. 31, 2008, which applications and patents are herein incorporated by reference in their entirety.

FIELD OF THE INVENTION

The present invention relates generally to firearms and, more particularly, to a revolver having an improved barrel mounted sight.

BACKGROUND OF THE INVENTION

Revolvers have changed very little in their overall design and operation in over 100 years, and are generally comprised of a frame, a cylinder, a firing mechanism and a barrel. As is known in the art, revolvers begin as metal blanks that are forged into close approximations of these major parts. After annealing or heat-treating the parts, they undergo basic machining processes such as milling, drilling and tapping. This manufacturing and assembly process is often relatively costly and can require a great deal of hand fitting to orient and align the various metal components with one another so that smooth operation and firing is achieved.

As alluded to above, a revolver is essentially comprised of four main components: a frame, a cylinder, a firing mechanism and a barrel. The frame generally includes one or more frame portions, often a main frame portion, a hand grip portion, and a trigger guard. The cylinder is mounted on the frame by a yoke and fits within a window in the frame. The cylinder has formed therein a plurality of chambers for receiving cartridges. As the trigger is pulled, the cylinder rotates in the frame to successively present the chambers to the barrel for firing. The cylinder also includes an ejector mechanism for removing cartridge casings subsequent to firing, and a cylinder retaining mechanism for holding the cylinder in place within the window in the frame during operation. Often, a cylinder release bar that can be moved via a thumb piece is provided to actuate the retaining mechanism and thereby allow the cylinder and yoke to be rotated away from the frame and into the cylinder-open position.

The firing mechanism of a conventional revolver includes a trigger, a sear, a hammer, a main spring and a pawl that is sometimes referred to as a "hand." When the revolver is in an operable mode, pulling the trigger causes the hand to move forward, reciprocate up and engage the ratchet, thereby rotating the ratchet and attached cylinder. However, this particular configuration requires that a slot be cut in the face of the frame in the breech face area to allow for the hand to move from the inner portion of the frame to engage the ratchet and turn the cylinder. Such a configuration results in increased manufacturing time and cost and requires that such components be hand fit precisely so that the revolver may operate smoothly.

Pulling the trigger also causes the sear and hammer to rotate away from the cylinder. The rotation away from the cylinder is resisted by the main spring. After a predetermined amount of travel, the sear and hammer disengage from the trigger and allow the spring to force the hammer toward the cylinder. The hammer is aligned with one of the cylinder chambers and the cylinder chamber, in turn, is aligned with the barrel. A firing pin on the hammer is positioned to strike the cartridge disposed in the chamber.

There is also an interest in designing firearms so that the inner parts of the revolver may be cleaned, serviced, repaired, etc. One solution to this problem is to provide a side plate on the side of the revolver that is pinned or otherwise secured to the frame of the revolver. The removal of the side plate allows access to the internal components of the revolver such as the hammer, sear, firing mechanism and hand. One drawback with the use of a side plate, however, is that the side plate can make the revolver less rigid and induces a series of a-symmetric stresses in the frame which can cause the frame to fatigue and ultimately fail over time. It is therefore a general object of the present invention to provide a revolver that is designed so as to allow access to the interior components while maintaining the structural rigidity of the frame.

A retaining mechanism is necessary to retain the cylinder within the rectangular aperture, especially subsequent to firing. Many prior art revolvers lock the yoke directly into the frame via known means. Other revolvers use a ball detent to restrain the forward end of the cylinder. Often times, however, when a round is discharged, the forces which propel the round down the length of the barrel exert a corresponding force in the opposite direction, that is, towards the rear, handgrip portion of the revolver. Although the effect of this opposite force is marginal on the interconnected elements of the revolver, the manufacturing tolerances inherent in the revolver permit a minute amount of structural translation to occur as a result of this incident and opposite discharge force. The effect of the structural translation of certain elements in the revolver may cause the cylinder and yoke assembly to move slightly rearwards, causing, e.g., a ball detent to disengage, thus facilitating the unintended pivoting of the cylinder from its closed position to its open position. In such a situation, the revolver must then be clicked back into its cylinder-closed position before additional firing. It is therefore a general object of the present invention to provide an improved cylinder retaining mechanism that will retain the cylinder within the frame during firing.

SUMMARY

The invention concerns a firearm. In one example embodiment the firearm comprises a frame. A barrel having a muzzle end, a breech end and a firing axis is connected to the frame. The barrel has at least one sight receiving flat on an exterior periphery thereof located adjacent to the muzzle end thereof. A shroud for housing the barrel has a receptacle formed on an upper surface thereof. The receptacle is in alignment with one of the flats on the barrel. A front sight is disposed within the receptacle such that a bottom portion of the sight is in registration with one of the flats so as to prevent rotation of the barrel. In one example embodiment the sight is secured in place by a pin. In a specific example embodiment the firearm comprises a revolver.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
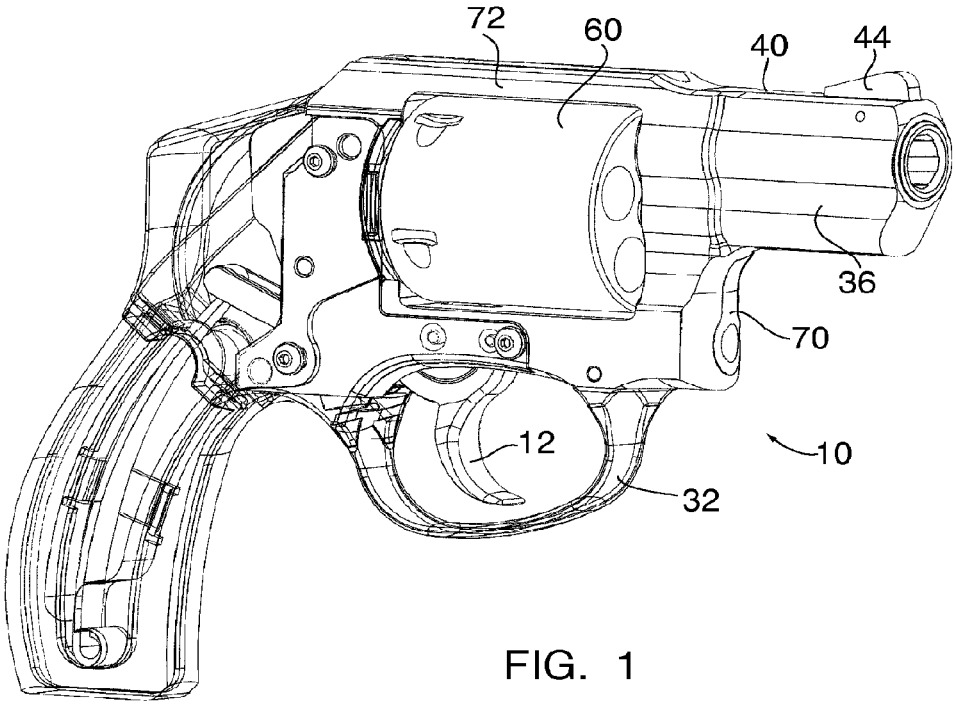
FIG. 1 is a perspective view of a revolver according to one embodiment of the present invention.

Referring to FIG. 1, one exemplary embodiment of a firearm incorporating the present invention is shown generally at 10 and is hereinafter referred to a as "firearm 10." The firearm 10 is preferably a revolver (as described in U.S. Pat. Nos. 6,330,761 and 6,523,294, which are incorporated herein by reference) that includes a frame, a cylinder, a firing mechanism, and a barrel. A firing axis extends coaxially with the barrel.

Figure 2:
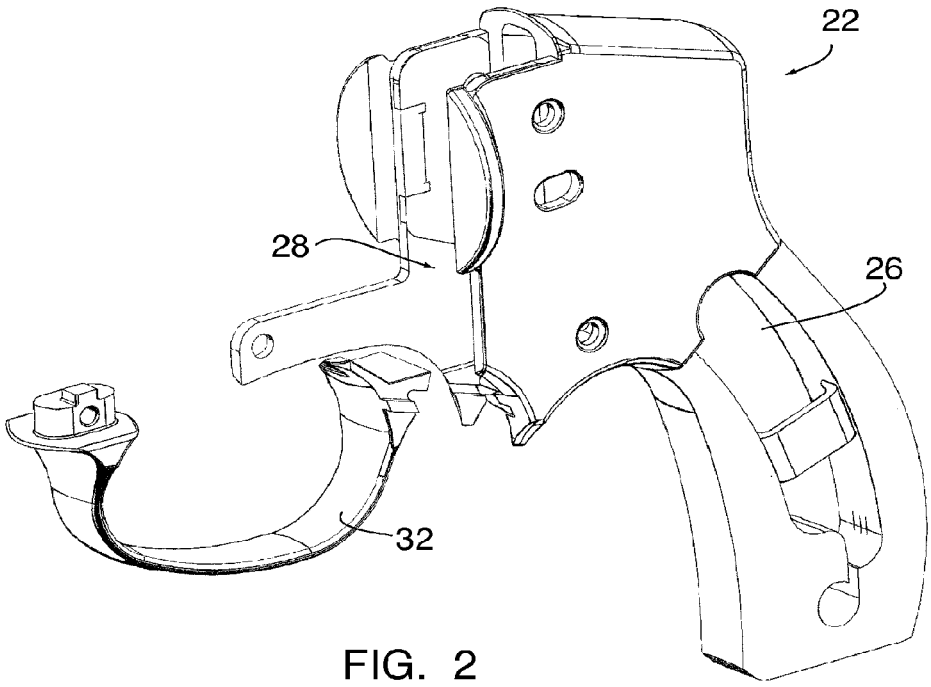
FIG. 2 is a perspective view of a lower frame portion and trigger guard of a revolver according to one embodiment of the present invention.
Figure 3:
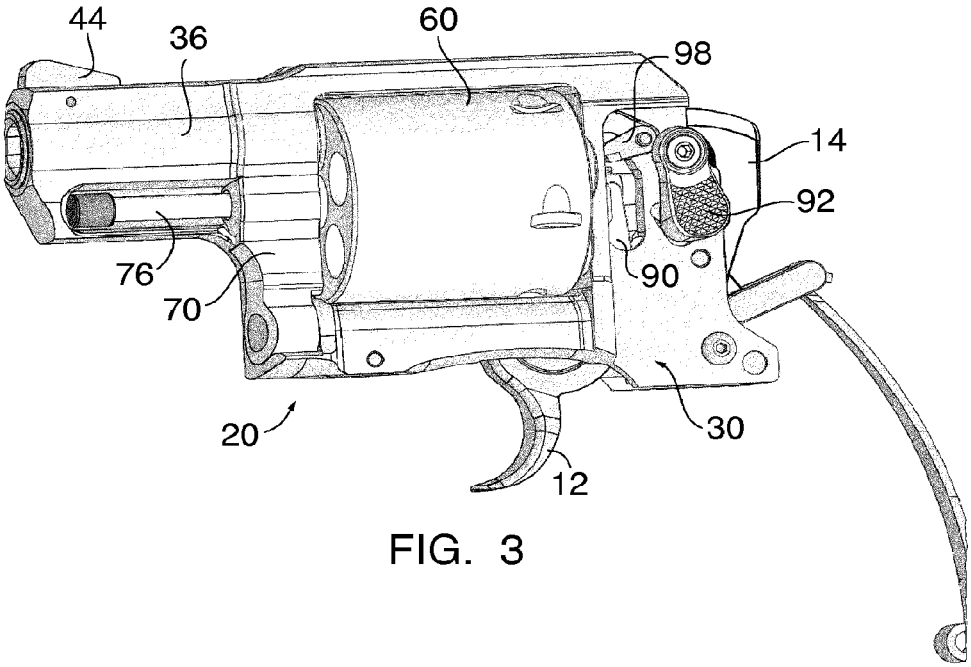
FIG. 3 is a perspective view of an upper frame portion and barrel and shroud assembly of a revolver according to one embodiment of the present invention.

The frame is generally comprised of two main parts, an upper frame portion 20 and a lower frame portion 22. FIGS. 2 and 3 illustrate perspective views of the lower 22 frame portion and upper frame portion 20, respectively. As shown in FIG. 2, the lower frame portion 22 contains the back strap, main spring housing 26 and the grip, as well as space for the internal firing mechanism. As shown in FIG. 3, the upper frame portion 20 houses the barrel 34, cylinder 60 and internal firing mechanism, as described in detail below. A forward end 28 of the lower frame portion 22 is shaped so as to accept a corresponding rearward end 30 of the upper frame portion 20. These upper and lower frame portions 20, 22 are joined together by pins to create a structurally rigid frame, although any other joining means known in the art may also be used. Importantly, there is no cut-out or accompanying side plate on either the upper or lower frame portions which is normally necessary to access the internal components of the revolver. Instead, due to the modular frame portions and the configuration thereof, the revolver may easily be broken down into its constituent frame parts and the internal components and mechanisms accessed in this manner. The absence of a side cut-out and side plate yields a more symmetrical, and therefore, stronger and more resilient frame.

The firearm frame portions are preferably comprised of metal stampings or inserts having a polymer over-molding on top of the inserts. It will be readily appreciated, however, that other metallic and nonmetallic materials may be used in the construction of the frame portions without departing from the scope of the present invention. Indeed, any polymer known in the firearm art may be used to form the upper and lower frame portions provided that sufficient strength and rigidity of the frame components is achieved. The metal inserts can also be varied in material and thickness to achieve a desired strength and rigidity.

As alluded to above, known methods of manufacturing firearms, and revolvers in particular, require the precision cutting, milling and fitting of many intricate parts. For example, known firearms require that a slot be cut in the breech face area to accommodate the hand which engages the ratchet on the cylinder to index the cylinder. Indeed, prior art revolvers must be bent and modified to ensure that the barrel, cylinder, firing and locking mechanisms all come into registration within prescribed tolerances so that the revolver operates properly. Importantly, such bending is not required with the polymer frame firearm of the present invention, as known polymer and other molding technologies may be employed to create all of the frame components so as to accommodate the barrel, cylinder, safety and firing mechanism without the need for any additional cutting, milling or modifying.

Importantly, the molded polymer frame portions 20, 22 are formed such that they generally define open receptacles preconfigured to receive component subassemblies. As will be readily appreciated, this obviates the need for the frame portions to be milled, cut, and bent to accommodate the individual component parts of the firearm. Instead, various subassemblies, such as the firing mechanism, trigger mechanism and barrel can be preassembled into subassemblies remote from the frame portions and simply "dropped" into the receptacles in the molded polymer frame portions 20,22 and pinned or otherwise secured in place. As a result of this configuration, the frame portions do not need to be substantially modified after the molding process to accommodate the component parts, thus cutting down on assembly and manufacturing time, as well cost.

As shown in FIG. 2, the frame also includes a separate trigger guard 32 that is releasably attached to the frame via a notch and groove type configuration and which is secured in place by a pin. The fact that the trigger guard 32 is removable allows a user to customize the accessories that are used with the revolver, such as accessories that may be placed on the forward portion of the trigger guard, e.g., laser sights, etc.

Referring now to FIGS. 1 and 3-5, the barrel 34 comprises an axially elongated generally cylindrical sleeve which projects forwardly from the upper frame portion 20 and is received within a barrel shroud 36. In one embodiment of the present invention, the barrel 34 may have a generally cylindrical rifled bore extending coaxially through it, the bore rifling being formed by conventional spiral rifling grooves cut in the wall of the bore, in a manner will known in the firearm and revolver art.

A rear portion of the barrel 34 is externally threaded (not shown) for mating engagement with internal threads (not shown) in a bore on the upper frame portion 20 of the firearm frame. In a preferred embodiment, the barrel 34 is threaded at 36 threads per inch, although different thread sizes and thread counts may be used. There is also a second set of threads 38 on the distal or muzzle end of the barrel 34 that are enlarged in diameter and have substantially the same thread count as the rear portion of the barrel 34. The barrel 34 may then be threaded through the shroud 36 and locked into place. Upon assembly of the firearm 10, the cylindrical bore registers with the respective chambers of the cylinder and forms the longitudinal firing axis.

The barrel shroud 36 includes a radially disposed and rearwardly facing abutment surface for complimentary engagement with the forwardly facing seating surface on the forward end of the upper frame portion 20 of the firearm frame. In one embodiment of the present invention, the upper surface 40 of the barrel shroud 36 is substantially flat and is provided with an axially elongated, upwardly open sight receiving groove 42 formed therein. The groove is adapted to receive a front sight 44 which is pinned or otherwise secured in fixed position to the shroud member 36.

The clearance between the forward-most surface of the cylinder and the rearward-most surface of the barrel is referred to as the barrel-cylinder (BC) gap. To set the barrel-cylinder gap, a crush washer 110 is used, with typical barrel-cylinder gap tolerances being in the range of 4,000ths to 10,000ths of an inch. In particular, to set the barrel-cylinder gap, there are a series of machine flats 48 provided on the outer circumference of the muzzle end of the barrel 34 in the approximate position where the front sight 44 is located. The barrel 34 is threaded through the shroud 36 and into the upper frame portion 20 against the metal frame insert until the threading crushes the metal washer 110. Once the predetermined tolerance is reached, the barrel is cocked slightly further so that one of the machine flats 48 comes to the surface. A pin is then passed through the shroud 36 and rides across the top of the given flat 48 on the barrel 34, locking the barrel 34 in place.

Figure 4:
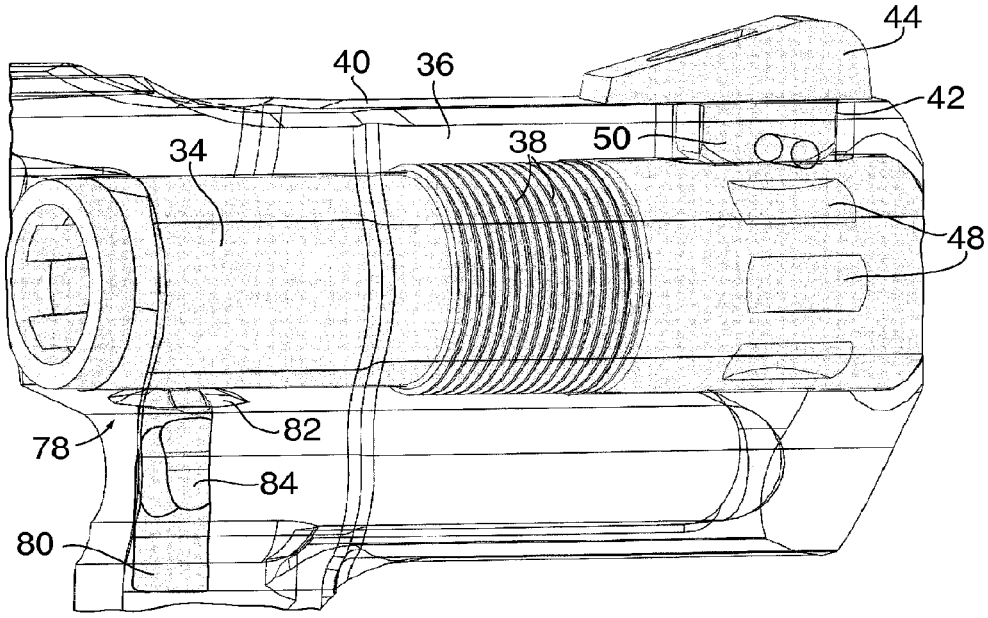
FIG. 4 is a detailed perspective view of a barrel, shroud and sight assembly of a revolver according to one embodiment of the present invention.
Figure 5:
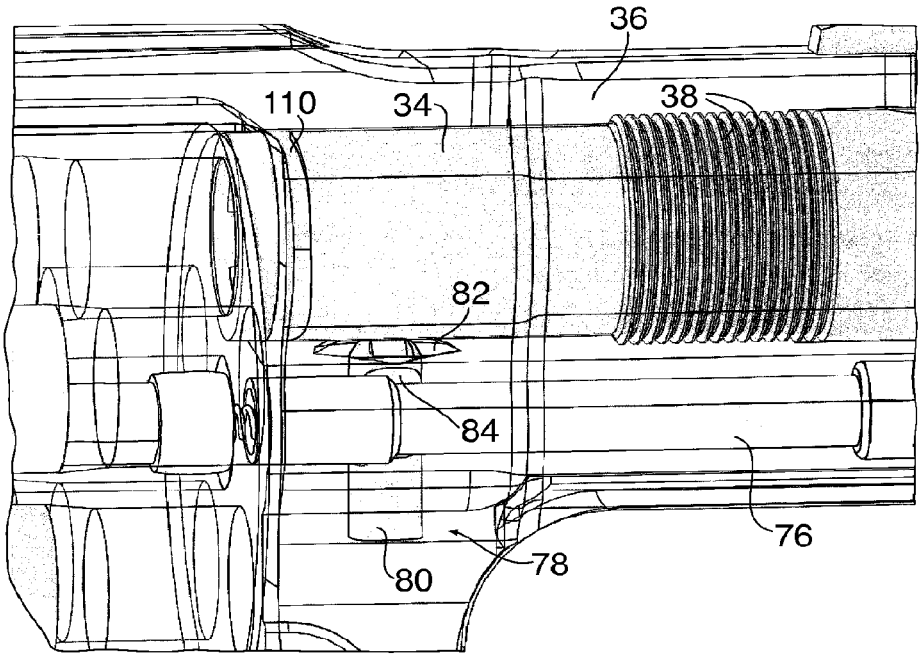
FIG. 5 is a detailed perspective view of a barrel and shroud assembly and a cylinder retaining mechanism of a revolver according to one embodiment of the present invention.
Figure 6:
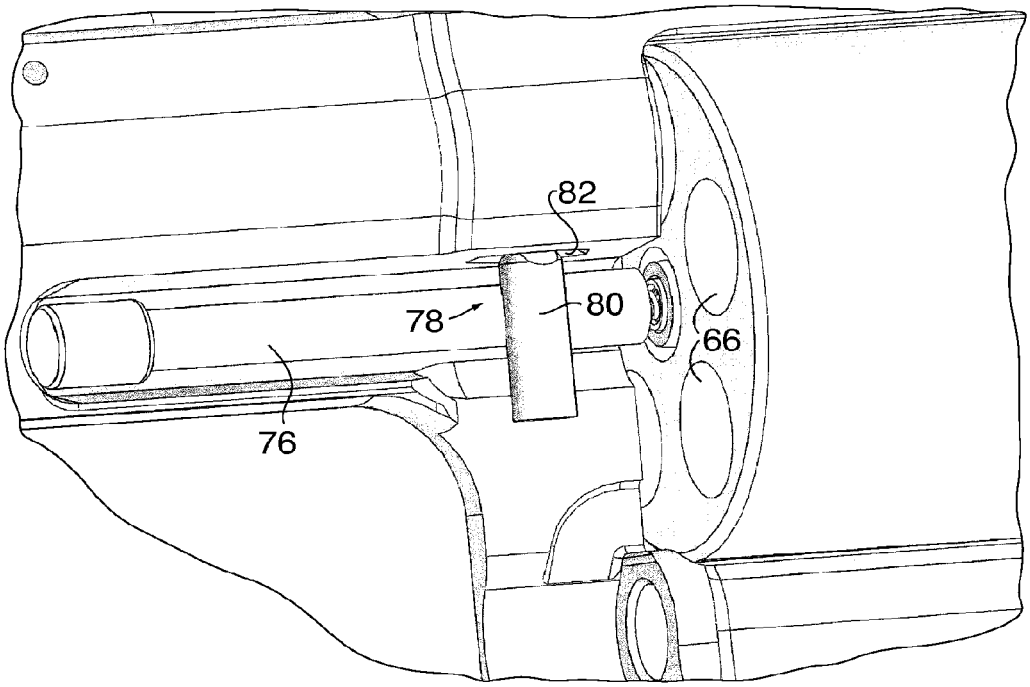
FIG. 6 is a perspective view of a cylinder retaining mechanism of a revolver according to one embodiment of the present invention.

Other sight configurations, such as a dove-tail sight, may also be used. In this embodiment, as shown in FIGS. 3 and 4, the barrel 34 is threaded through the shroud 36 and into the upper frame portion 20 against the metal frame insert until it crushes the metal washer 110. Once the predetermined tolerance is reached, the barrel is cocked slightly further so that one of the machine flats 48 comes into alignment with the sight receiving groove 42. A dove-tail front sight 44 may be placed into the sight receiving groove 42 and removably attached to the shroud 36 via a pin through the shroud 36 and sight 44. The bottom tab 50 of the sight 44 is received in the machine flat 48 and held in place by the pin, locking the barrel 34 in place.

Turning now to FIGS. 1 and 3-6, a cylinder 60 and yoke 70 are shown. The cylinder 60 is pivotally mounted in the upper frame portion 20 and includes an ejector 62, a ratchet 64, and a plurality of chambers 66. The chambers 66 are configured to receive and align cartridges 68 with the barrel 34. The cylinder 60 is pivotally mounted on a yoke 70 that is attached to the frame via a yoke stud. A top strap 72 extends across a top portion of the frame from a forward portion to a rearward portion to define a generally rectangular aperture 74. When the cylinder 60 is closed with respect to the yoke 70, the cylinder 60 is positioned in the rectangular aperture 74 such that a chamber 66 of the cylinder 60 is longitudinally aligned with the barrel 34.

As will be readily appreciated, all known revolvers require a retaining mechanism to retain the cylinder within the rectangular aperture 74, especially subsequent to firing. In one embodiment of the present invention, the cylinder retaining mechanism comprises an ejector rod 76 that is spring-biased forward and a ball detent mechanism 78. The spring-biased ejector rod 76 contacts a portion of the frame adjacent the tip of the ejector rod, thereby holding the cylinder in place. To further ensure that the cylinder does not come out of battery during firing, ball detent mechanism 78 is also provided.

The ball detent mechanism includes a vertical pin 80 with a substantially round head that is received within a corresponding shallow recess 82 on the underside of upper frame portion 20. In the preferred embodiment, vertical pin 80 is biased by a coil spring, or the functional equivalent thereof, towards shallow recess 82 when the firearm is in the cylinder-closed position, although no biasing means need be employed. Vertical pin 80 is mounted in yoke 70 along an axis that is perpendicular to the bore-axis/firing axis and, importantly, perpendicular to the axis along which the majority of recoil forces are generated. This orientation of the ball detent mechanism 78 will not allow the yoke 70 to be released and the cylinder 60 to be urged open due to recoil forces associated with discharge of the firearm. Vertical pin 80 also has includes flat 84 that is in registration with the ejector rod 76 and is axially movable along an axis perpendicular to the firing axis of the firearm 10. Both the spring-biased ejector rod 76 and the ball detent mechanism 78 prevent the yoke 70 from releasing during the firing of the gun. This design is advantageous because it allows for a simpler design and therefore the use of fewer parts than prior art retaining mechanisms.

Figure 7:
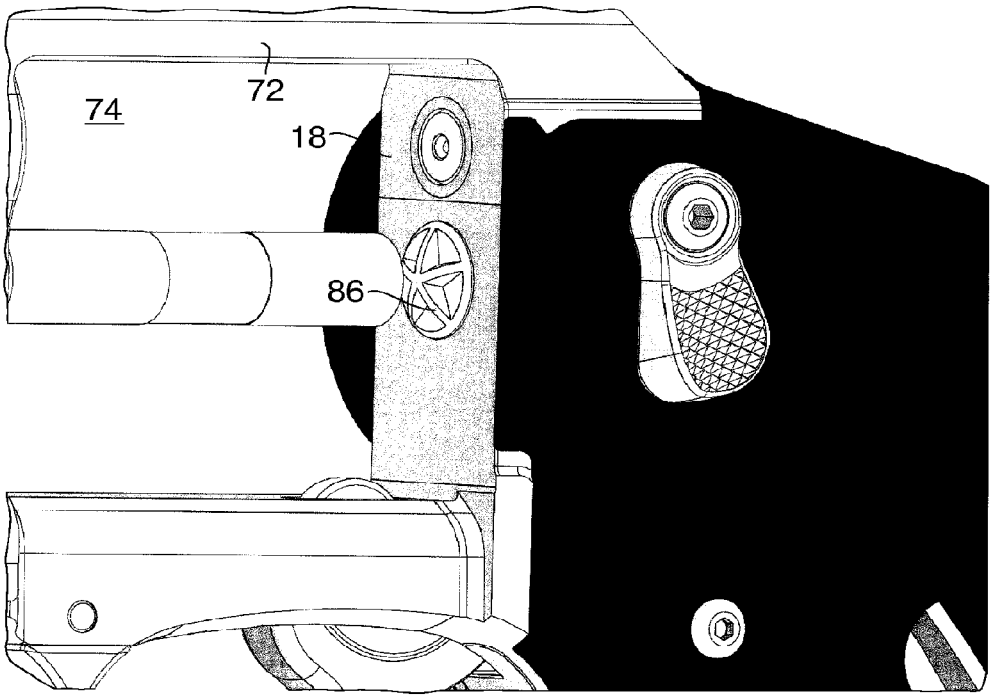
FIG. 7 is a perspective view of a ratchet drive mechanism and breech face of a revolver according to one embodiment of the present invention.
Figure 8:
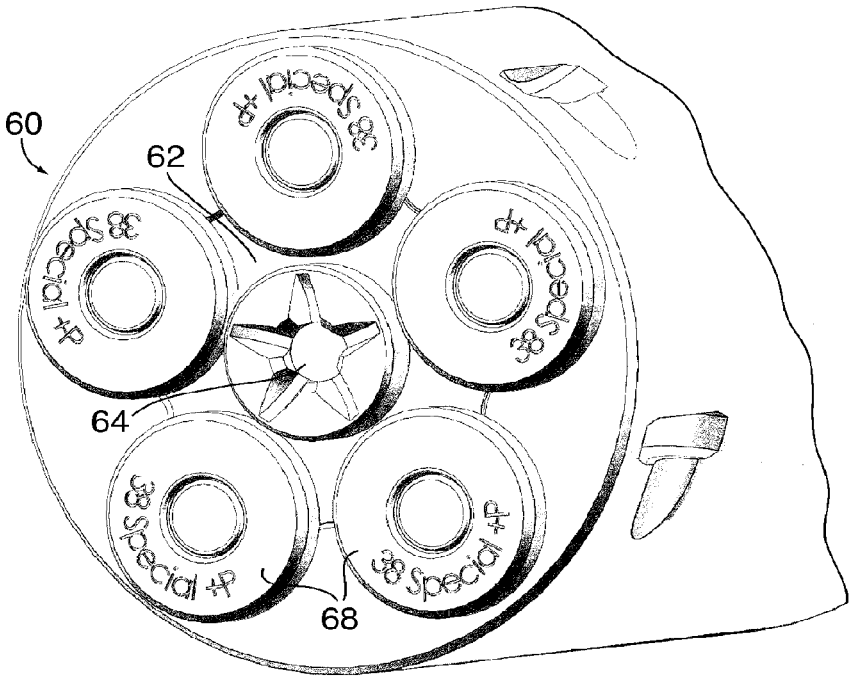
FIG. 8 is a perspective view of a cylinder and ratchet mechanism according to one embodiment of the present invention.
Figure 9:
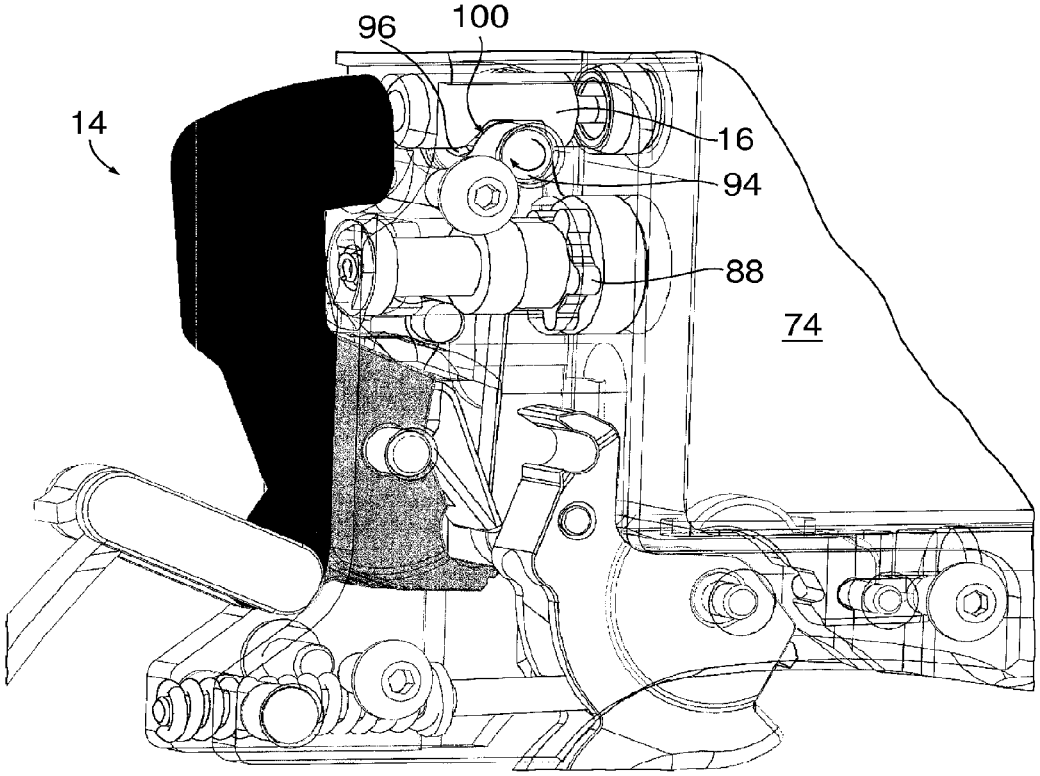
FIG. 9 is a perspective view of a ratchet drive mechanism, trigger, hammer, firing pin and safety of a revolver according to one embodiment of the present invention.
Figure 10:
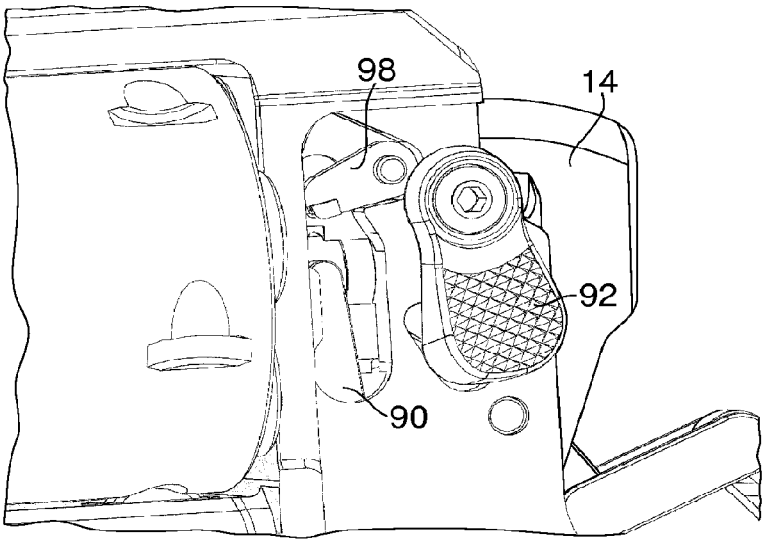
FIG. 10 is a perspective view of a ratchet drive mechanism, hand and latch of a revolver according to one embodiment of the present invention.
Figure 11:
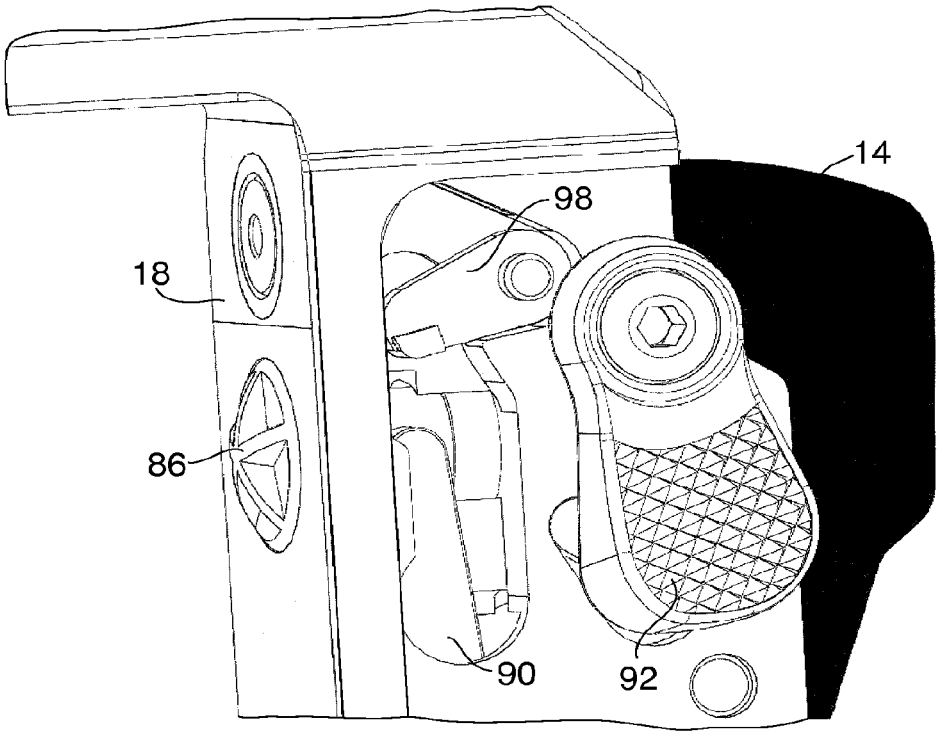
FIG. 11 is a perspective view of a ratchet drive mechanism, hand and latch of a revolver according to one embodiment of the present invention.

FIGS. 7-12 illustrate the drive mechanism of the firearm 10. As known in the art, the drive mechanism functions to rotate the cylinder 60 upon the pulling of the trigger 12 to place a new cartridge 68 into alignment with the hammer 14 and firing pin 16. According to one embodiment of the present invention, a complimentary set of star-shaped configurations are used to rotate/index the cylinder 60. This star-shaped configuration replaces the commonly-used ratchet mechanism. As shown in FIG. 8, the cylinder is provided with a star-shaped socket 64 on its rearward-facing surface. As shown in FIG. 7, a rotatable shaft mounted within the frame and having a complimentary star-shaped hub/head 86 extends through the breech face area 18 below the firing pin 16 and is configured to engage the star-shaped ratchet mechanism 64 on the cylinder 60. It will be readily appreciated, however, that the cylinder may have a male head configuration and the portion of the drive mechanism that extends through the breech face may comprise the corresponding female socket.

As best shown in FIGS. 9-12, there is internal to the frame a supplemental ratchet surface 88 on the rearwardly extending portion of the hub/head 86 whose geometry is such that it is configured to receive on the lower surface a top portion of the newly designed hand 90. It is this interior mounted ratchet surface 88 that receives the hand 90. The hand 90 reciprocates up and down in a vertical fashion, and does not need any lateral forward motion or backward motion to rotate the hub 86. Simple vertical reciprocal motion of the hand 90 upon pressing of the trigger 12 then causes the pin to be pushed upward to index the cylinder 60. The hand 90 is then is reciprocated downward at the end of the firing stroke.

As alluded to above, prior art drive mechanisms necessitated that a slot be cut in the frame in the breech face area to allow the hand to be urged from the interior portion of the gun to a ratcheting mechanism on the center portion of the cylinder to rotate the cylinder. As will be readily appreciated, this hand, ratchet and slot design was costly to manufacture and was very time consuming to align the parts with the needed precision. The present invention therefore benefits from the improved hub/head and interior hand and ratchet mechanism in that no slot need be cut in the breech face area of the frame because the hand does not move laterally out of the interior of the firearm, but instead reciprocates vertically, as described below.

Figure 12:
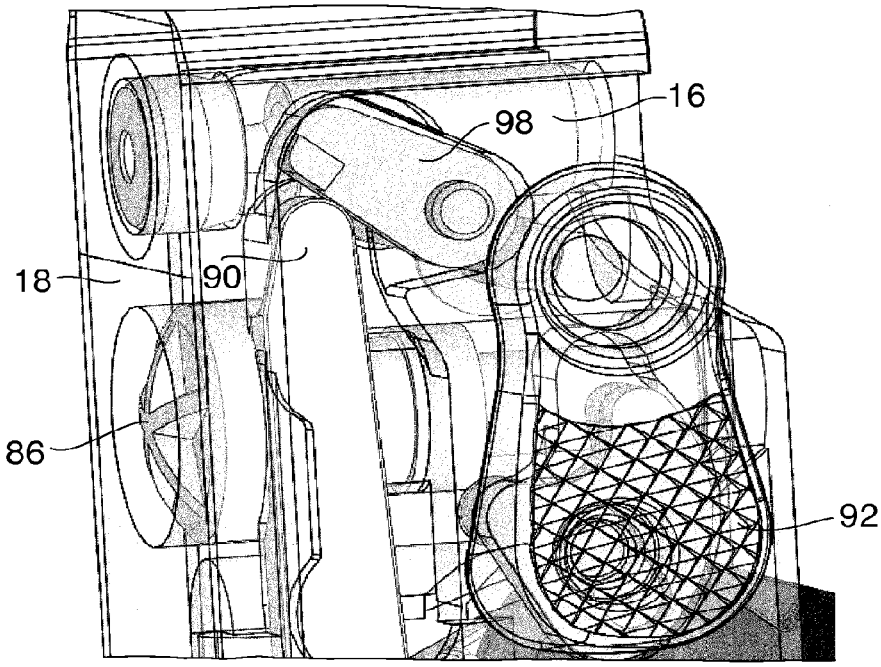
FIG. 12 is a perspective view of a ratchet drive mechanism, hand, firing pin, safety and latch of a revolver according to one embodiment of the present invention.

With the cylinder indexing mechanism of the present invention, however, there is also a need to disengage the hub 86 from the cylinder 60 so that the cylinder 60 and yoke 70 can be rotated out of the frame, such as when an operator wishes to eject spent cartridges 68 and reload. As shown in FIGS. 7, 10, 11 and 12 a latch mechanism 92 reciprocates the hub 86 in a direction substantially parallel to the firing axis of the firearm 10. This reciprocal movement causes the hub 86 to be placed into and out of engagement with the star-shaped ratchet mechanism 64 on the cylinder 60. If an operator desires to place the firearm 10 in the cylinder-open position, the latch 92 is actuated, which retracts the star-shaped hub 86 back behind the breach face area 18 and out of engagement with the star-shaped ratchet 86 on the cylinder 60. This retracted position is best shown in FIG. 12. Upon releasing the latch 92, the star-shaped hub 86 extends back through the breech face area 18 to engage the corresponding star-shaped ratchet mechanism 64 on the cylinder 60.

The present invention also contemplates using either or both of a hammer block and a firing pin block as a safety feature to prevent the unintended discharge of the firearm. In the preferred embodiment, there is a firing pin block, as is shown in FIGS. 9-12. According to one embodiment of the present invention, the firing pin block comprises a generally cylindrical blocking member 94 with a flat surface or relieved portion 96 provided thereon. When the trigger 12 is in a non-depressed position, the flat surface or relieved portion 96 on the blocking member 94 is not in registration with the corresponding relieved portion 100 on the underside of the firing pin 16. As relieved portions 100, 96 of the firing pin and blocking member are not in registration with one another, no clearance is provided for the firing pin, as the full diameter portion of the blocking member 94 contacts the firing pin 96. This prevents the firing pin 16 from striking a chambered cartridge unless the trigger is pulled, even if the hammer is released due to a faulty components or the pin is struck by another object.

When the trigger 12 is pulled, however, hand 90 reciprocates up and contacts a lever arm 98 fixedly attached to blocking member 94. As hand 90 goes through its full stroke, it pushes against lever arm 98, causing blocking member 94 to rotate so that relieved portion 96 is in registration with relieved portion 100 on the underside of the firing pin 16. When in registration with one another, the relieved portions 96,100 provide a clearance that allows the firing pin 16 to release and strike a cartridge. At rest, the pin 94 is urged back into action such that it comes forward and engages the firing pin 16, holding it in place.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A firearm, comprising:

a frame;

a barrel having a muzzle end, a breech end and a firing axis connected to the frame, said barrel having at least one sight receiving flat on an exterior periphery thereof located adjacent to said muzzle end thereof;

a shroud for housing said barrel, said shroud having a receptacle formed on an upper surface thereof and in alignment with one of said flats on said barrel;

a front sight disposed within said receptacle such that a bottom portion of said sight is in registration with one of said flats so as to prevent rotation of said barrel, wherein said sight is secured in place by a pin oriented tangential to said barrel at the location of said one flat.

2. The firearm according to claim 1, wherein said firearm comprises a revolver.

* * * * *